US007821479B2

(12) United States Patent
Zhang

(10) Patent No.: US 7,821,479 B2
(45) Date of Patent: Oct. 26, 2010

(54) ROLLING LIGHT EMITTING DIODE SCREEN DEVICE

(75) Inventor: Wei Yang Zhang, Hong Kong (CN)

(73) Assignee: Carex Lighting Equipment (Dong Guan) Company Limited, Yan Tian Village, Feng Gang Town, Dong Guan Guangdon ( * ) Notice: Subject to any disclaimer, the term of this patent is extended or adjusted under 35 U.S.C. 154(b) by 713 days.

(21) Appl. No.: 11/575,917

(22) PCT Filed: Sep. 28, 2005

(86) PCT No.: PCT/CN2005/001592

§ 371 (c)(1),
(2), (4) Date: Mar. 23, 2007

(87) PCT Pub. No.: WO2006/037267

PCT Pub. Date: Apr. 13, 2006

(65) Prior Publication Data

US 2008/0055106 A1 Mar. 6, 2008

(30) Foreign Application Priority Data

Oct. 8, 2004 (CN) ..... 2004 1 0080603

(51) Int. Cl.
*G09G 3/00* (2006.01)

(52) U.S. Cl. ..... 345/82; 345/110

(58) Field of Classification Search ..... 345/83
See application file for complete search history.

(56) References Cited

U.S. PATENT DOCUMENTS

| | | | | |
|---|---|---|---|---|
| 5,717,424 | A * | 2/1998 | Simson et al. | 345/110 |
| 5,900,850 | A | 5/1999 | Bailey et al. | |
| 6,323,832 | B1 * | 11/2001 | Nishizawa et al. | 345/83 |
| 6,677,918 | B2 | 1/2004 | Yuhara et al. | |

FOREIGN PATENT DOCUMENTS

| | | |
|---|---|---|
| CN | 1274906 | 11/2000 |
| DE | 10011497 A1 | 9/2001 |
| JP | 2000-47600 | 2/2000 |

* cited by examiner

*Primary Examiner*—Richard Hjerpe
*Assistant Examiner*—Jeffrey S Steinberg
(74) *Attorney, Agent, or Firm*—Thomas R. Vigil

(57) ABSTRACT

A rolling light emitting diode screen device includes a plurality of equilong rigid supporting stripes, a plurality of pixel units which are disposed with a equal interval in a straight line on the rigid supporting stripes, electric signal lines and power lines connected to respective pixel units, and a control device. It is characterized that it further includes a flexible frame, and the plurality of rigid supporting stripes are aligned at both ends, and are disposed parallel with an equal interval on the flexible frame, so that a pixel matrix plane is formed on the rigid supporting stripes. The flexible frame engages the rigid supporting strips and the pixel units thereon to roll around an axis parallel to the axis of the rigid supporting stripes to form a reel. The rolling LED screen device of the invention is easy to be stored, transported and mounted, wirings thereof are easy to be disposed, not easy to be damaged, and easy to repair.

19 Claims, 3 Drawing Sheets

ROLLING LIGHT EMITTING DIODE SCREEN DEVICE

CROSS-REFERENCE TO RELATED APPLICATIONS

The present patent application is a §371 of International Application No. PCT/CN2005/001592 filed on Sep. 28, 2005 and claiming priority to Chinese patent application serial no. 200410080603.3 filed on Oct. 8, 2004 in the name of NCW (HOLDINGS) LIMITED.

TECHNICAL FIELD

The present invention relates to a light emitting diode (LED) screen device, particularly relates to a LED screen device using for large screen display.

BACKGROUND ART

LED screen devices are widely used in large screen display for business, architectures, and stages. In order for easy mounting and transporting, current LED devices for large screen display are mostly assembled by several smaller LED screens. U.S. Pat. No. 6,677,918 published such a LED display system. The large screen includes several rigid frames assembled together On every rigid frame, a plurality of rigid supporting stripes are disposed perpendicularly with equal intervals. And a plurality of RGB pixel units are disposed with equal intervals on every rigid supporting stripe, so as to form a RGB pixel matrix. The display system also includes signal transmission lines, and power lines connected to respective pixel units, and a control system. The control system receives outside video signals, converts the signals into digital signals, and transfers the correct pixel display data to the LED driver after the process of the computer, so as to control the operation of every pixel units. Because every RGB pixel unit consists of a red, a blue, and a green LED, it is able to generate any visible color including white and black. Hence, the large screen can display all kinds of still or moving color pictures. The invention used the method of assembling for large screens, however, all frames are rigid, and of the same size, so it is very inconvenient for mounting and transporting and the control system is relatively complicated. U.S. Pat. No. 6,362,801 published another LED display system, whose large screen is of flexible nets. The pixel units are disposed with equal intervals on the nets to form regular pixel matrix. However, the wirings are too complicated, hence hard for maintenance.

SUMMARY OF THE INVENTION

The objective of the invention is to solve the problems of the current technologies of large screen LED display systems, such as inconvenience of mounting and transporting, and complication of wirings, and to provide a LED screen device of simple structure, and easy to be mounted and transported.

The objective of the invention is realized as followings. A rolling light emitting diode screen device includes one or more equilong rigid supporting stripes, one or more pixel units which are disposed with a equal interval in a straight line on the rigid supporting stripes, electric signal lines and power lines connected to respective pixel units, and a control device, it is characterized that it further includes a flexible frame which corresponding a rigid supporting stripe, and each rigid supporting stripes are aligned at both ends, and are disposed parallel with an equal interval on the flexible frame, so that a pixel matrix plane is formed on the rigid supporting stripes, the flexible frame engages the rigid supporting stripes and the pixel units thereon to roll around an axis parallel to the axis of the rigid supporting stripes to form a reel.

It is characterized that the rolling LED screen device further includes a rigid frame, which includes a rigid axis parallel to the rigid supporting stripes, the rigid supporting stripes and the pixel units thereon can form a pixel matrix plane, and also can roll around the axis to form a reel driven by the flexible frame.

It is characterized that the rolling LED screen device further includes an electrical motor placed on the rigid frame, which drives the rigid axis of the flexible frame to roll, and further to make the rigid supporting stripes to slide along the track and roll around the rigid axis to form a reel. The rolling LED screen device is characterized by the followings. The flexible frame is a rolling screen; and the rigid frame is a reel box, there are hookers on top of the reel box, and there is a reel and an electrical motor in the reel box, the electrical motor can drive the reel to roll; there is an opening on the bottom of the reel box, below the opening, both sides of the reel box connect the fixing frame which can be easily removed and fixed, and the reel is connected to the top of rolling screen fixedly; the rolling screen can be fixed in the fixing fame to form a pixel matrix plane.

It is characterized that the rolling LED screen device further includes tracks, along which the ends of the rigid supporting stripes can move vertically.

The rolling LED screen device is characterized in that the pixel unit consists of at least one red LED, one blue LED, and one green LED.

The rolling LED screen device is characterized in that the pixel unit consists of a full color LED. It is characterized that the rolling LED screen device can be assembled to form a large screen, and the pixel matrix planes of the plurality of the rolling LED screen devices are on the same plane. For the realization of the invented rolling LED screen device, the LED screen can be rolled to a reel by hand or by the electrical motor when it is not being used by using the flexible frame to fix the pixel units disposed on the rigid supporting stripes and due to the rolling design of the flexible frame. Hence, it is easy to be stored, transported, and mounted. Moreover, the wirings are easy to be setup and maintained, and hard to be damaged because the pixel units are disposed on the rigid supporting stripes.

DETAILED DESCRIPTION OF THE PREFERRED EMBODIMENT

Figure 1:
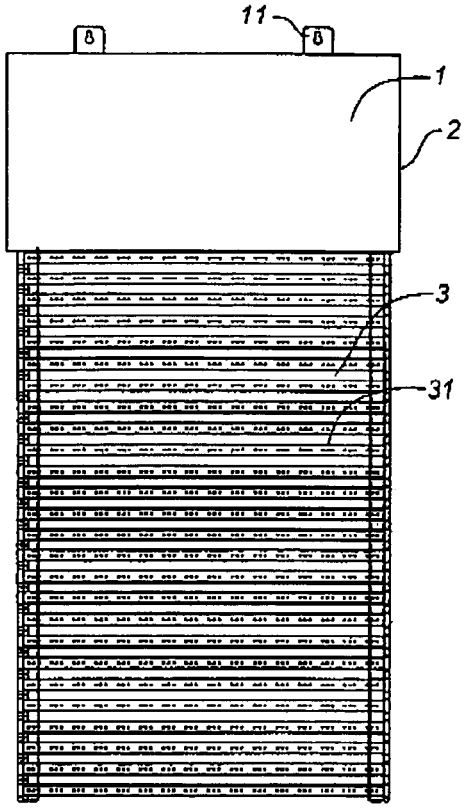
FIG. 1. Schematic of the first embodiment of the invented rolling LED screen device.
Figure 2:
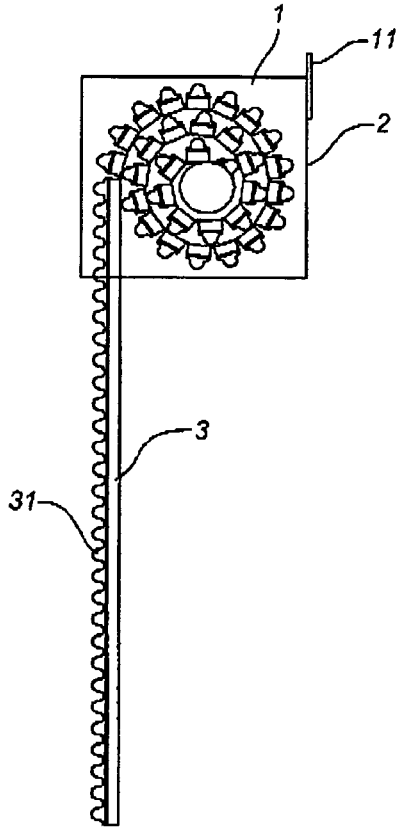
FIG. 2. Lateral view of the rolling LED screen device in FIG. 1.
Figure 3:
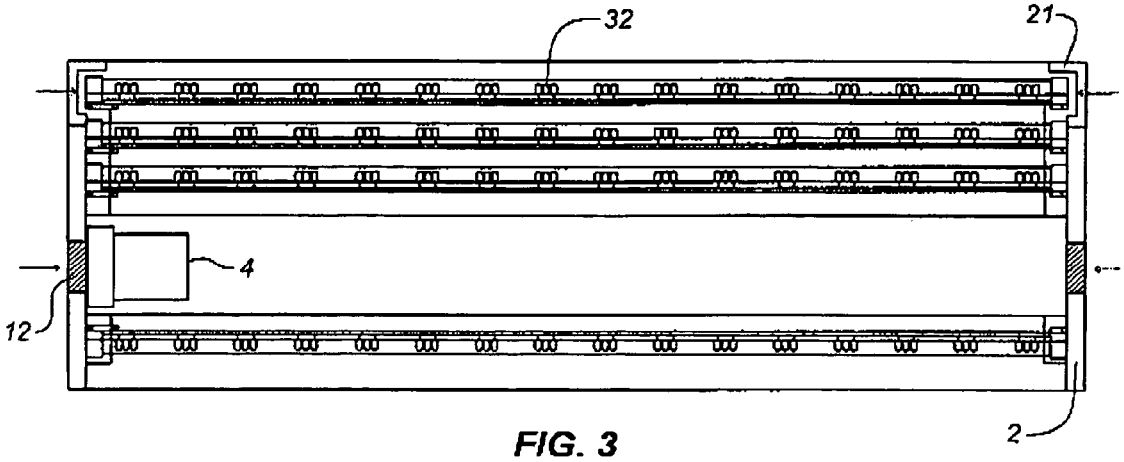
FIG. 3. Schematic of the reel structure of the rolling LED screen device in FIG. 1.

Shown in FIG. 1, FIG. 2 and FIG. 3, in the first embodiment of the invention, the rolling LED screen device includes reel box 1, rigid fixing frame 2, rolling screen 3 and electrical motor 4. The rolling screen 3 is made of the rigid materials with flexibility, such as plastic, stainless steel, alloy, et al.

Thereon place at least one or more equilong rigid supporting stripes 31 made of alloy. The supporting stripes 31 are aligned at both ends and are placed parallel with the same intervals on the rolling screen 3.

At least one or more pixel units are aligned in line and disposed with the same intervals on the rigid supporting stripes 31. The aligned pixel units 32 form a pixel matrix plane when the screen 3 is unrolled.

There are hookers 11 on top of the reel box 1.and within the reel box 1 there is a reel 12 and the electric motor 4. The electric motor 4 can drive the reel 12 to roll. There is an opening on the bottom of the reel box 1. Below the opening, both sides of the reel box connects the rigid fixing frame 2 which can be easily removed and fixed; and the reel 12 is connected to the top of rolling screen 3 fixedly. The tracks 21 are set in the rigid fixing frame 2. Both ends of the rigid supporting stripes 31 disposed on the rolling screen 3 are constrained within the rigid fixing frame 2 and can move vertically along tracks 21. Hence, in the working state, the rolling screen 3 is unrolled and positioned in the rigid fixing frame 2 to form display plane after the electric motor 4 is started. When the work is done, the rolling screen 3 will be rolled into the reel box 1 after the electric motor 4 is started. Because the rigid fixing frame can be removed easily, it is easy to be stored and transported. As shown in FIG. 3 the tracks 21 have a generally U shape or a generally channel shape for receiving the ends of the rigid supporting stripe 31.

Figure 4:
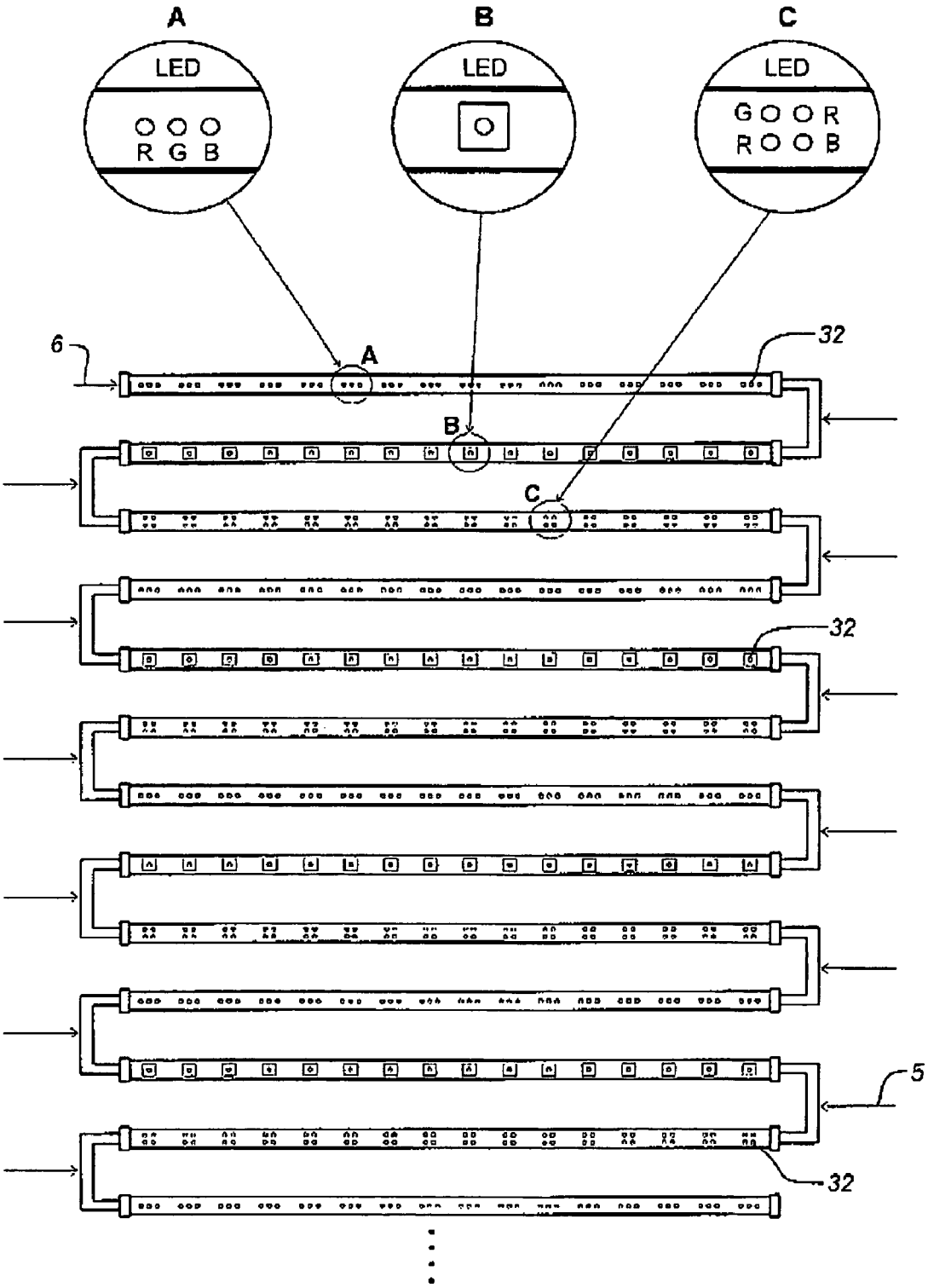
FIG. 4. Schematic of the wiring interconnection of the rolling LED screen device in FIG. 1.
Figure 5:
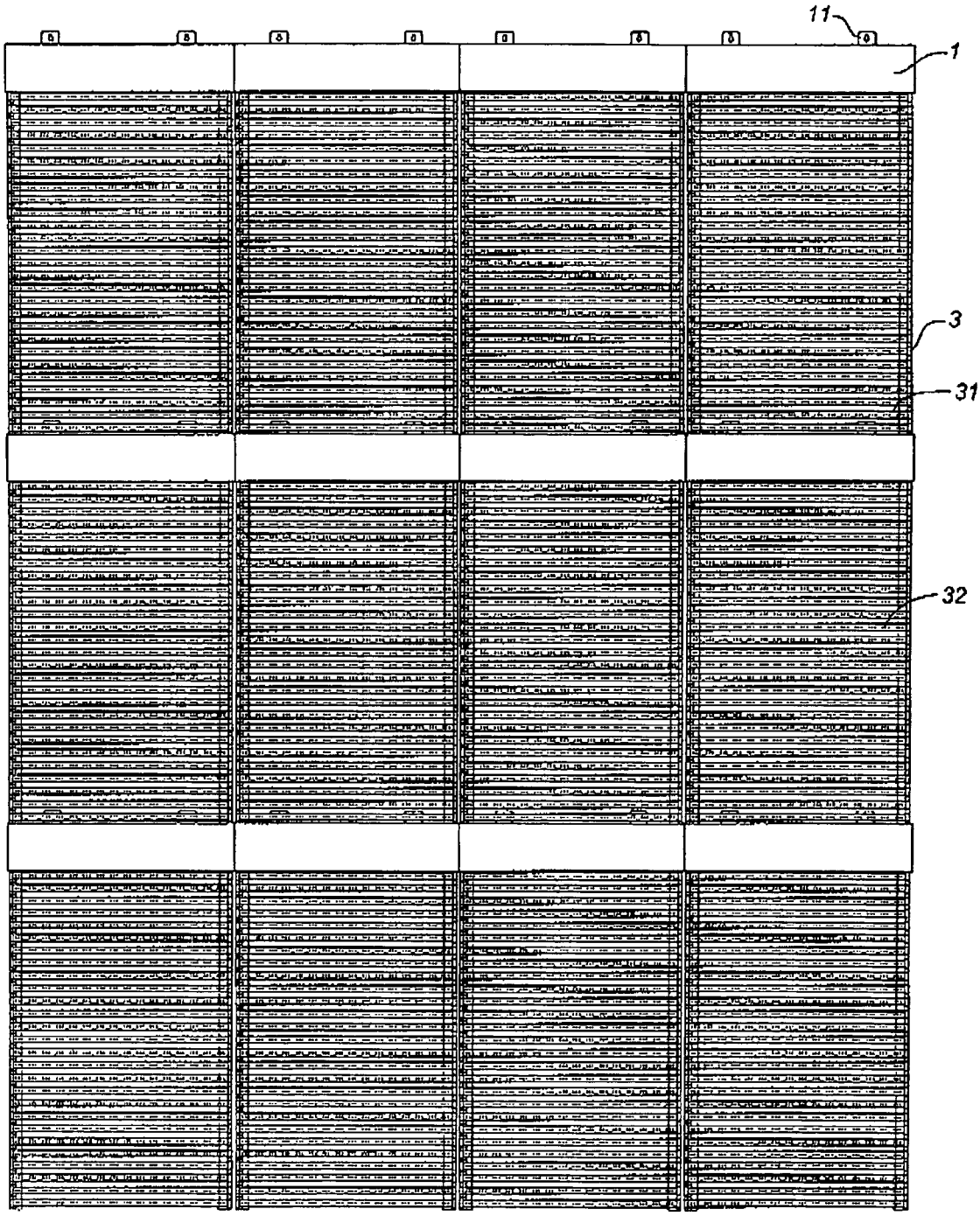
FIG. 5. Schematic of the second embodiment of the invented rolling LED screen device.

Shown in FIG. 4, on the back or side of the pixel unit 32, the electrical signal lines 6 and power line 5 are connected to the respective pixel units 32.The screen device also includes a control system. The control system receives outside video signals, converts the video signals into digital signals, and transfers the correct pixel display data to the LED driver after the process of the computer, so as to control the operation of the pixel units 32. The circuit can use the current circuit technology, which will not be described in detail here. Because the pixel units 32 are disposed on the rigid supporting stripes, the wirings are easy to be setup and maintained, and hard to be damaged The pixel unit 32 can consist of one red LED, one blue LED and one green LED, or consist of a full color LED, or consist of several red LED's, several blue LED's, and several green LED's. Shown in FIG. 5, in the second embodiment of the invention, twelve rectangular rolling LED screen devices of the same size are assembled together to form a large 4*3 matrix screen. Video signals can be displayed in the large screen assembled by the several invented rolling LED screen devices by the controlling of the control system.

What is claimed is:

1. A rolling light emitting diode screen device comprising one or more equilong rigid supporting stripes, one or more pixel units which are disposed with a equal interval in a straight line on the rigid supporting stripes, electric signal lines and power lines connected to respective pixel units, and a control device, a flexible frame with a rigid supporting stripe, and said rigid supporting stripes are aligned at both ends, and are disposed parallel with an equal interval on the flexible frame, so that a pixel matrix plane is formed on the rigid supporting stripes, the flexible frame engages the rigid supporting stripes and pixel units thereon to roll around an axis parallel to the axis of the rigid supporting stripes to form a reel, and tracks on a rigid fixing frame, with the ends of the rigid supporting stripes being disposed on the rolling screen and can move vertically along the tracks.

2. A rolling LED screen device as set forth in claim 1, further includes a said rigid fixing frame, which includes a rigid axis parallel to the rigid supporting stripes, the rigid supporting stripes and the pixel units thereon can form a pixel matrix plane, and also can roll around the axis to form a reel driven by the flexible frame.

3. A rolling LED screen device as set forth in claim 2, further includes an electrical motor placed on the rigid frame, which drives the rigid axis of the flexible frame to roll, and further to make the rigid supporting stripes to slide along the track and roll around the rigid axis to form a reel.

4. A rolling LED screen device as set forth in claim 1, characterized in that the flexible frame is a rolling screen; and the rigid frame is a reel box, hookers being provided on top of the reel box, and there is a reel and an electrical motor in the reel box, below the opening, and both sides of the reel box connect the fixing frame which can easily be removed and fixed, and the reel is connected to the top of the rolling screen fixedly, and the rolling screen is fixed in the fixing frame to form a pixel matrix plane.

5. A rolling LED screen device as set forth in claim 1, characterized in that the pixel unit consists of at least one red LED, one blue LED and one green LED.

6. A rolling LED screen device of claim 1 characterized in that the pixel unit consists of a full color LED.

7. A rolling LED screen device of claim 2 characterized in that the flexible frame is a rolling screen; and the rigid frame is a reel box, there are hookers on top of the reel box, and there is a reel and an electrical motor in the reel box, the electrical motor can drive the reel to roll; there is an opening on the bottom of the reel box, below the opening, both sides of the reel box connect the fixing frame which can be easily removed and fixed, and the reel is connected to the top of rolling screen fixedly; the rolling screen can be fixed in the fixing frame to form a pixel matrix plane.

8. A rolling LED screen device of claim 2 characterized in that the pixel unit consists of at least one red LED, one blue LED and one green LED.

9. A rolling LED screen device of claim 2 characterized in that the pixel unit consists if a full color LED.

10. A rolling LED screen device of claim 7 further comprising said tracks on the fixing frame, and the ends of the rigid supporting stripes being disposed on the roiling screen and can move vertically along the tracks.

11. The rolling LED screen device of claim 10 wherein said tracks have a generally U or channel shape.

12. The rolling LED screen device of claim 1 wherein said tracks have a generally U or channel shape.

13. A roiling light emitting diode screen device includes one or more equilong rigid supporting stripes (31), one or more pixel units (32) which are disposed with a equal interval in a straight line on the rigid supporting stripes (31), electric signal lines (6) and power lines (5) connected to respective pixel units (32), and a control device, wherein it further includes a flexible frame which corresponding a rigid supporting stripe (31) are aligned at both ends, and are disposed parallel with an equal interval on the flexible frame, so that a pixel matrix plane is formed on the rigid supporting stripes (31), the flexible frame engages the rigid supporting stripes (31) and pixel units (32) thereon to roil around an axis parallel to the axis of the rigid supporting stripes (31) to form a reel, characterized in that the flexible frame is a rolling screen; and a rigid frame is a reel box (1), there are hookers (11) on top of the reel box (1), and there is a reel (12) and an electrical motor (4) in the reef box (1), the electrical motor (4) can drive the reel (12) to roll; there is an opening on the bottom of the reel box (1), below the opening, both sides of the reel box (1) connect the fixing frame which can be easily removed and fixed, and the reel (12) is connected to the top of rolling screen (3) fixedly; the rolling screen (3) can be fixed in the fixing frame to form a pixel matrix plane.

14. A rolling LED screen device as set forth in claim 13 characterized in that the rigid frame includes a rigid axis parallel to the rigid supporting stripes (31), the rigid supporting stripes (31) and the pixel units (32) thereon can form a pixel matrix plane, and also can roll around the axis to form a reel driven by the flexible frame.

15. A rolling LED screen device of claim 13 characterized in that the electrical motor (4) is placed on the rigid frame and drives the rigid axis of the flexible frame to roll, and further to make the rigid supporting stripes (31) to slide along the tracks (21) and roll around the rigid axis to form a reel.

16. A rolling LED screen device of claim 13 further includes tracks (21) on the fixing frame, the ends of the rigid supporting stripes (31) disposed on the rolling screen can move vertically along the tracks (21).

17. A rolling LED screen device of claim 13 characterized in that the pixel unit (32) consists of at least one red LED, one blue LED and one green LED.

18. A rolling LED screen device of claim 13 characterized in that the pixel unit (32) consists of a full color LED.

19. A rolling LED screen device of claim 13 Characterized in that the pixel unit consists of a full color LED.

* * * * *